US007654658B2

(12) United States Patent
Tatsumi et al.

(10) Patent No.: US 7,654,658 B2
(45) Date of Patent: Feb. 2, 2010

(54) CONSUMABLE PRODUCT CONTAINER AND IMAGE FORMING APPARATUS

(75) Inventors: Setsuji Tatsumi, Kanagawa (JP); Yoshihiro Ito, Saitama (JP); Satoru Okamoto, Saitama (JP)

(73) Assignee: Fujifilm Corporation, Tokyo (JP)

( * ) Notice: Subject to any disclaimer, the term of this patent is extended or adjusted under 35 U.S.C. 154(b) by 566 days.

(21) Appl. No.: 11/431,562

(22) Filed: May 11, 2006

(65) Prior Publication Data

US 2006/0256173 A1 Nov. 16, 2006

(30) Foreign Application Priority Data

May 12, 2005 (JP) ..... 2005-140180

(51) Int. Cl.
*B41J 2/175* (2006.01)

(52) U.S. Cl. ..... 347/86

(58) Field of Classification Search ..... 347/84, 347/85, 86

See application file for complete search history.

(56) References Cited

U.S. PATENT DOCUMENTS 6,145,972 A * 11/2000 Udagawa et al. ..... 347/86
6,893,119 B2 * 5/2005 Ushiro ..... 347/86
6,918,642 B2 * 7/2005 Horigome ..... 347/5

FOREIGN PATENT DOCUMENTS

JP 2004-122750 A 4/2004

* cited by examiner

*Primary Examiner*—Anh T. N. Vo
(74) *Attorney, Agent, or Firm*—Birch, Stewart, Kolasch & Birch, LLP

(57) ABSTRACT

An ink cartridge, which is removably set in a printer, has an ink chamber storing ink, an absorbent chamber containing a sponge that absorbs the ink from the ink chamber and holds it, and a fuel chamber storing a liquid fuel to be supplied to a fuel cell of the printer. The fuel chamber is located outside and adjacent to the ink chamber, so that the ink stored in the ink chamber is kept in a constant temperature range. Data on residual amounts of the ink and the fuel in the ink cartridge are detected by a residual ink detector and a residual fuel detector of the printer, and are written in a memory card that is removably attached to the ink cartridge.

7 Claims, 6 Drawing Sheets

CONSUMABLE PRODUCT CONTAINER AND IMAGE FORMING APPARATUS

FIELD OF THE INVENTION

The present invention relates to a consumable product container that contains a consumable product such as ink, toner or recording paper. The present invention relates also to an image forming apparatus that uses the consumable product container.

BACKGROUND OF THE INVENTION

Many kinds of image forming apparatuses that use a consumable product container have been known. For example, an ink jet printer uses a number of ink cartridges that contain different color inks from each other, or an integrated ink cartridge that contains different color inks. An electrostatic copier uses a toner cartridge as a consumable product container. The ink cartridges and the toner cartridges are expected to be recycled. So the used-up consumable product containers are collected and refilled with the ink or the toner in a recycling factory, or the collected containers are disassembled to sort out the parts according to their materials. The recovered materials are used for forming new containers. Also a cassette containing recording paper is used as a consumable product container in the image forming apparatus. The cassette includes a type capable of reloading the recording paper as a consumable product, and a type incapable of reloading the recording paper so the cassette of this type should be changed as the whole with a new one.

Such an image forming apparatus has recently been known that uses the consumable product container, and has a battery as a power source. The image forming apparatus mounting the battery is also made compact and handy, so that it is portable and usable everywhere.

As the battery, a fuel cell attracts attention as it scarcely pollutes the atmosphere, and coverts energy at a high efficiency. The fuel cell is a power generation device that generates electric energy by chemical action between hydrogen and oxygen. There are many kinds of fuel cells: solid oxide fuel cells that use oxide ion conductive solid electrolyte and whose operating temperature is about 1000 degrees centigrade, phosphoric acid fuel cells that use phosphoric acid solution as an electrolyte and whose operating temperature is about 200 degrees centigrade, molten carbonate fuel cells that use molten carbonate as an electrolyte and whose operating temperature is about 600 degrees centigrade, polymer electrolyte fuel cells that use solid polymer as an electrolyte and operate at the room temperature, and so on. These fuel cells are supplied with fuel such as hydrogen, methanol, gasoline, natural gas and DME (dimethyl ether).

Among these fuel cells, the polymer electrolyte fuel cells are noticed as preferable for use in a mobile apparatus, as it is small and light, operates at the room temperature, and achieves a high energy density. Among the polymer electrolyte fuel cells, direct methanol fuel cells is superior in view of the facts that they do not need a reforming device for reforming hydrogen, and that they generate power by supplying liquid methanol directly to electrodes, because methanol is easy to handle and inexpensive. So a study of using the direct methanol fuel cell as a power source in a mobile electronic apparatus is being made. Also a printer mounting the fuel cell has been known for example from Japanese Laid-open Patent Application No. 2004-122750.

The most advantageous feature of the fuel cell is that it is unnecessary to charge it, but it has only to replenish the cell with the fuel when the cell runs down. However, there is concern about how to carry the fuel around for use in replenishing the fuel cell, as well as where to sell the fuel for replenishment. Besides that, if the fuel for replenishment leaks while it is being carried around, it can be dangerous and pollute the environment. Encasing the fuel for replenishment safely enough can raise the packaging cost.

SUMMARY OF THE INVENTION

In view of the foregoing, a primary object of the present invention is to provide an image forming apparatus that forms an image using a consumable product, e.g. ink or toner, and permits replenishing a fuel cell as a power source with fuel easily and safely, and an optimum consumable product container that is removably set in the image forming apparatus, and supplies the consumable product to the image forming apparatus.

According to the present invention, a consumable product container containing a consumable product to be used for an image forming apparatus to form an image, comprises a consumable product storage chamber for storing the consumable product; and a fuel chamber for storing fuel to be supplied to the fuel cell, the fuel chamber being located around and adjacent to the consumable product storage chamber.

According to an embodiment wherein the fuel is a liquid fuel, the fuel chamber may be located at least on a top of the consumable product chamber, and a fuel spout for feeding out the fuel to the image forming apparatus may be provided at a lower part of the fuel chamber in a posture as the consumable product container is mounted in the image forming apparatus. In that case, a top wall portion of a partitioning wall between the consumable product storage chamber and the fuel chamber is preferably inclined such that the liquid fuel flows down to the fuel spout.

In a case where the consumable product is ink, and the consumable product storage chamber is parted into an ink chamber storing the ink and an absorbent chamber containing an absorbent that absorbs the ink from the ink chamber and holds the ink, the fuel chamber is preferably located around the ink chamber.

The consumable product may be toner. In that case, the consumable product container may be a program cartridge, into which a toner storage chamber, a photoconductive drum for forming an electrostatic latent image thereon, an electrifying device for electrifying the photoconductive drum, a developing roller for developing the electrostatic latent image into a toner image by use of the toner supplied from the toner storage chamber, a cleaning blade for recovering the toner from the photoconductive drum, and a toner recovery chamber for collecting the recovered toner are integrated.

According to a preferred embodiment, a memory for storing data on the consumable product and the fuel is removably attached to the consumable product container.

According to the invention, an image forming apparatus that operates using electric power supplied from a fuel cell, comprises:

a mounting section for setting a consumable product container removably in the image forming apparatus, the consumable product container having a consumable product storage chamber storing a consumable product used for forming an image, and a fuel chamber for storing fuel to be supplied to the fuel cell, the fuel chamber being located around and adjacent to the consumable product storage chamber to form an integral body;

first and second residual amount detectors for detecting residual amounts of the consumable product and the fuel in the consumable product storage chamber and the fuel chamber respectively after a power switch is turned on;

a residual amount data pickup device for picking up data on the residual amounts of the consumable product and the fuel from the first and second residual amount detectors; and a writing device for writing the data on the residual amounts as picked up by the residual amount data pickup device in a memory along with other data relating to the consumable product and the fuel.

According to a preferred embodiment, an image forming apparatus further comprises a comparing device for comparing data on the residual amounts as stored previously in the memory with data on the residual amounts as picked up presently, and a notifying device for giving a predetermined notification when the comparing device shows that the residual amount of the consumable product or the fuel get more than before.

According to another preferred embodiment, the data on the residual amounts include data indicating that the consumable product or the fuel is used up, and an image forming apparatus further comprising a notifying device for notifying a need to change the consumable product container upon receipt of the data indicating that the consumable product or the fuel is used up.

As the fuel chamber is provided around the consumable product chamber in the consumable product container of the invention, the user or operator of the image forming apparatus can replenish the fuel cell with the fuel just by changing the consumable product container, without dirtying the hands and without any danger. The fuel contained in the fuel chamber also functions as a heat isolating material for isolating the consumable product storage chamber from heat, so the consumable product, such as ink or toner, is kept in a good condition.

By detecting the residual amounts of the consumable product and the fuel in the consumable product container, it becomes possible to notify the time to change the consumable product container. By storing the data on the residual amounts in the memory and comparing the stored data with the data indicating the present residual amounts, it becomes possible to detect that the consumable product container is not new or a recycled one.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
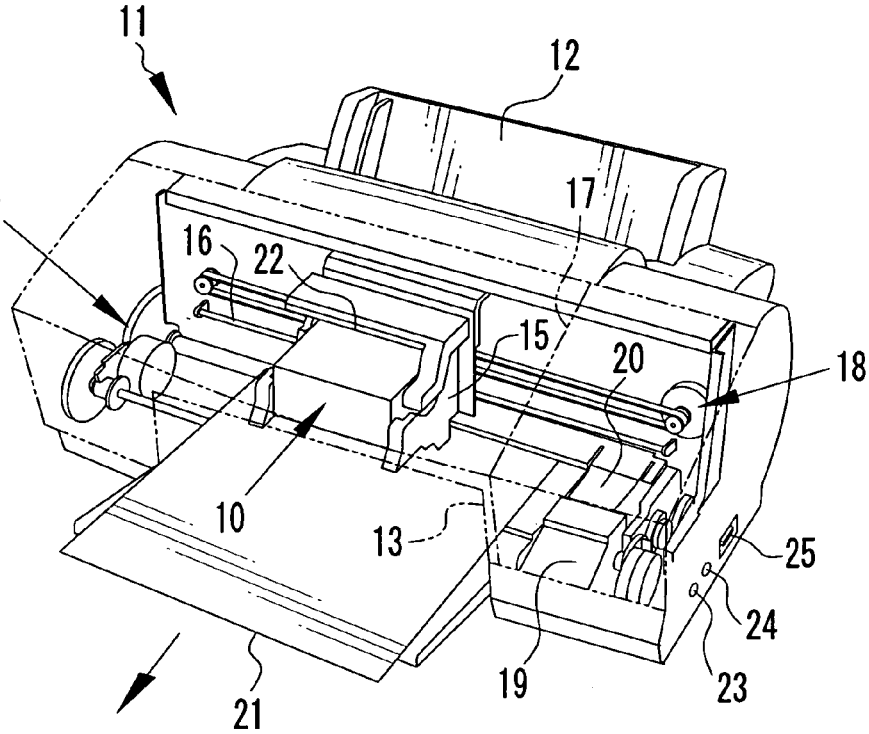
FIG. 1 is a perspective view of an ink jet printer embodying the present invention, partly transparent to show its interior.

FIG. 1 shows an ink jet printer 11 as an image forming apparatus. An ink cartridge 10 as a consumable product container is removably attachable to the ink jet printer 11. The ink cartridge 10 has an ink storage chamber as a consumable product storage chamber. The ink storage chamber contains ink as a first consumable product. The ink jet printer 11 is provided with a paper guide 12, an paper exit 13, a paper feeding mechanism 14 including conveyer rollers, a carriage 15, a guide bar 16, a lid 17, a carriage shift mechanism 18, a control section 19 including a controller, and a fuel cell 20.

Paper sheets 21 for recording an image thereon are set in the paper guide 12. The paper feeding mechanism 14 feeds the paper sheets 21 one after another into a paper path of the ink cartridge 10, and discharges them down through the paper exit 13 after the images are recorded thereon.

The carriage 15 is movable in a direction perpendicular to the conveying direction of the paper sheet 21, and is moved by the carriage shift mechanism 18, while being guided along a guide bar 16. The carriage 15 carries a recording head 53, see FIG. 4, such that the recording head ejects the ink toward the recording paper 21. The carriage 15 has a mounting section 22 above the recording head 53, for mounting the ink cartridge 10 removably on the carriage 15, so the ink is fed from the ink cartridge 10 to the recording head 53. The printer lid 17 is exposed to outside, and is opened for changing the ink cartridge 10.

The control section 19 converts image signals, which are fed from external apparatuses, into drive signals that are used for driving the recording head 53 to eject the ink. The fuel cell 20 generates electric power while being supplied with liquid fuel, to drive the printer 11 with the electric power.

The printer 11 is provided with a power switch 23 and a cartridge changing button 24. Upon the power switch 23 being turned on, the fuel cell 20 starts generating the power, to supply the printer 11 with the power. Simultaneously, it is checked if the carriage 15 is in a standby position that is at an end of the shift direction. If not, the carriage 15 is reset to the standby position. The standby position is outside the paper path, and the recording head 53 is covered with a cap in the standby position, in order to prevent evaporation of the ink from the ink cartridge 10. Upon the cartridge changing button 24 being turned on, the carriage 15 moves from the standby position to a changing position where the ink cartridge 10 is exposed when the printer lid 17 is opened.

The printer 11 is provided with a connecting section 25 for connecting external apparatuses, such as a personal computer, an electronic camera and a camera phone, to the printer 11 through wires. The control section 19 of the printer 11 converts images signals, which are entered through the connecting section 25, into drive signals, and drives the recording head 53 based on the drive signals, while controlling the paper feeding mechanism 14 cooperation with the carriage shifting mechanism 18. So the carriage 15 and thus the recording head 53 are moved to a predetermined position of the recording paper 21, and droplets of the ink are ejected from the recording head 53 toward the recording paper 21, to record an image on the recording paper 21. After the image recording is completed, the carriage 15 is moved back to the standby position.

Figure 2:
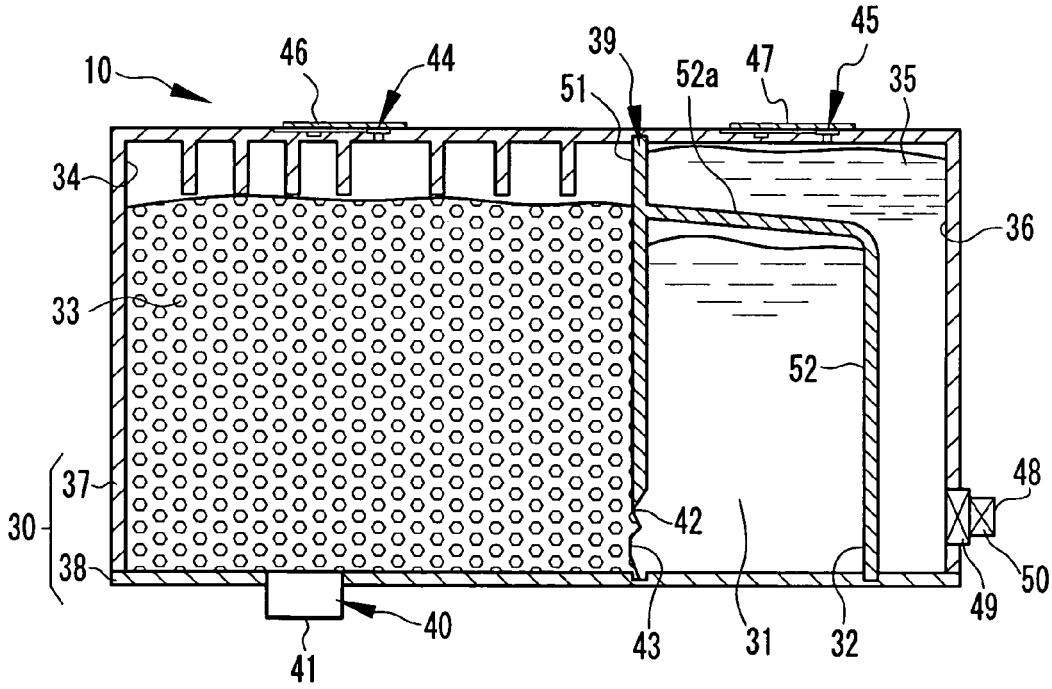
FIG. 2 is a sectional view of an ink cartridge.

The printer 11 is a monochrome printer, so the ink cartridge 10 contains black ink. As shown in FIG. 2, the interior of a cartridge case 30 of the ink cartridge 10 is parted into an ink chamber 32 storing the ink 31, an absorbent chamber 34 containing an ink absorbent 33, and a fuel chamber 36 containing the liquid fuel 35. The ink absorbent 33 is a sponge made of a soft porous material, that absorbs the ink from the storage chamber 32 and holds it. In the present embodiment, the ink chamber 32 and the absorbent chamber 34 constitutes the consumable product storage chamber, whereas the fuel chamber constitutes a second consumable product storage chamber.

The cartridge case 30 of the ink cartridge 10 is constituted of a main body 37, a lid 38, and partitioning walls 39. The ink cartridge 10 is manufactured by setting the partitioning walls 39 in the main body 37 to divide it into the chambers, inserting the sponge 33, the ink 31 and the liquid fuel 35 in the absorbent chamber 34, the ink chamber 32 and the fuel chamber 36 respectively, and thereafter securing the lid 38 to the main body 37. The cartridge case 30 is at least partly made of a transparent resin material.

An ink spout 40 is formed on a bottom portion of the absorbent chamber 34, for supplying the ink 31 to the recording head 53. The ink spout 40 is closed with a sealing member 41, which is broken when the ink cartridge 10 is attached to the carriage 15.

The ink chamber 32 is located in adjacent to the absorbent chamber 34. The partitioning wall 39 between the ink chamber 32 and the absorbent chamber 34 has a cutout 42, and a flexible film 43 is put on the cutout 42, to isolate the ink chamber 32 from the absorbent chamber 34 in the cutout 42. The flexible film 43 is pulled out from the cartridge case 30 immediately before the ink cartridge 10 is attached to the carriage 15. Thereby, the ink 31 is fed from the ink chamber 32 to the absorbent chamber 34. Designated by 44 and 45 are an air introduction hole of the absorbent chamber 34 and that of the fuel chamber 36 respectively. The air introduction holes 44 and 45 are closed with seals 46 and 47. When the ink cartridge 10 is used, the seals 46 and 47 are partly removed to expose the air introduction holes 44 and 45 partly.

Figure 3:
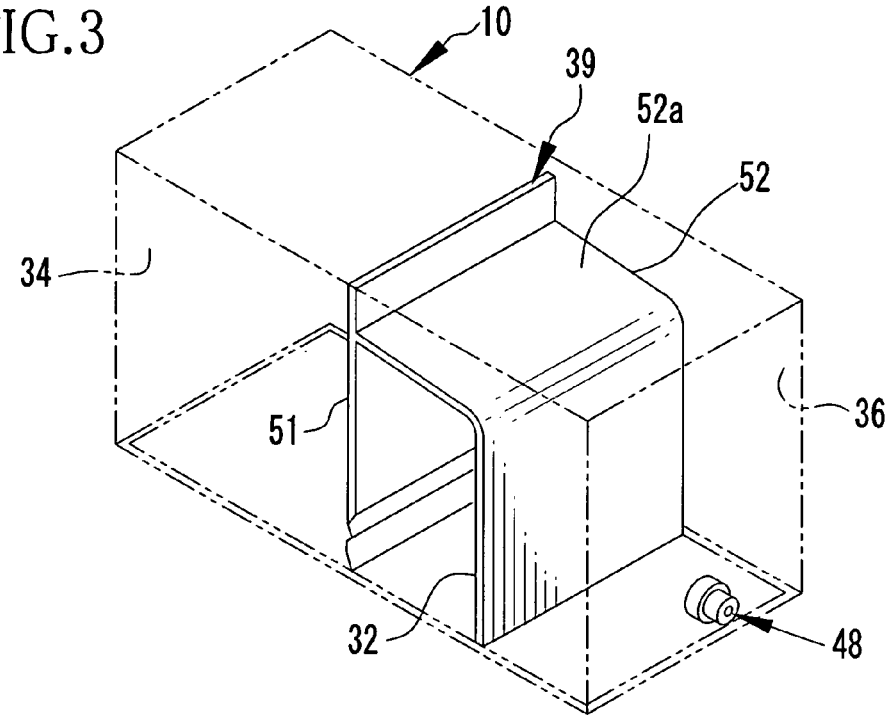
FIG. 3 is a perspective view of the ink cartridge, illustrating its exterior transparently to show its interior.

The fuel chamber 36 is formed around the ink chamber 32. For example, in an upright posture of the ink cartridge 10 as shown in FIGS. 2 and 3, the fuel chamber 36 is formed above and on one side of the ink chamber 32, the opposite side to the absorbent chamber 34, so the fuel chamber 36 has an L-shaped vertical section. The fuel chamber 36 preferably contains the liquid fuel 35 of an amount enough for permitting the fuel cell 20 to supply power to the printer 11 till the ink 31 in the ink cartridge 10 is used up. The fuel chamber 36 has a fuel spout 48 that is exposed to outside. In the present invention, the fuel spout 48 may be called a second consumable product outlet. In the fuel spout 48, there are a check valve 49 and an on-off valve 50. The check valve 49 prevents reverse flow of the liquid fuel 35. The on-off valve 50 closes the fuel spout 48 until the ink cartridge 10 is mounted on the carriage 15, and automatically opens when the carriage 15 moves to the standby position after the ink cartridge 10 is mounted on the carriage 15.

As shown in FIG. 3, the partitioning walls 39 consist of a first partitioning wall 51 between the absorbent chamber 34 and the ink chamber 32, and a second partitioning wall 52 between the ink chamber 32 and the fuel chamber 36. The first partitioning wall 51 extends vertically from an inner wall of the lid 38 to the top wall of the main body 37 in the upright posture. The partitioning wall 52 is of L-shaped and extends from an upper part of the first partitioning wall 51 to another part of the inner wall of the lid 38. A roof portion 52*a* of the partitioning wall 52 inclines downward so that the liquid fuel 35 flows smoothly down into the fuel spout 48 in the fuel chamber 36.

Figure 4:
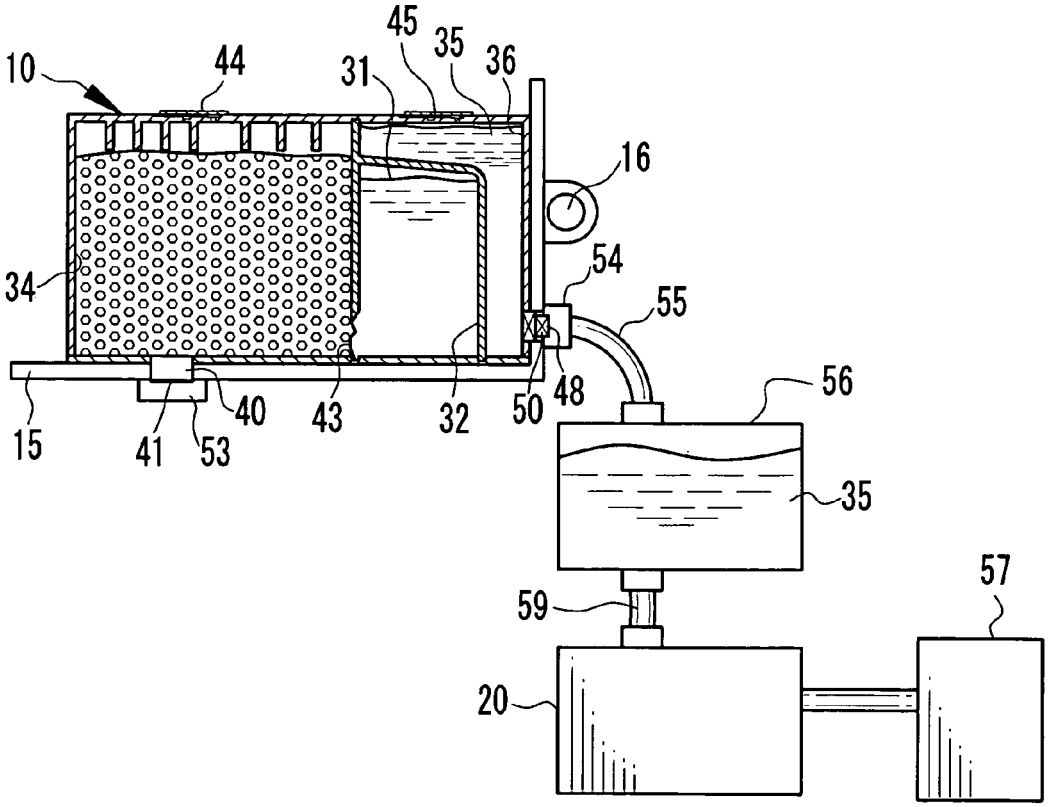
FIG. 4 is an explanatory diagram illustrating the ink cartridge attached to the ink jet printer.

As shown in FIG. 4, there is a fixed connector 54 in the standby position of the carriage 15, and the fuel spout 48 of the ink cartridge 10 is connected to the connector 54 when the carriage 15 moves to the standby position. The on-off valve 50 is opened in cooperation with the connection of the fuel spout 48 to the connector 54.

The connector 54 is connected to a pipe 55. The pipe 55 is connected to a fuel tank 56. The fuel tank 56 is placed below the carriage 15, and previously contains the liquid fuel 35 that is to be used till the ink cartridge 10 is changed. The fuel tank 56 is connected to a pipe 59 for supplying the liquid fuel 35 to the fuel cell 58, so the printer 11 generates power using the liquid fuel 35 as contained in the fuel tank 56. The fuel cell 58 is also connected to a water tank 57 for receiving water that is sub-produced from the fuel cell 58 while it is generating power.

Before the ink cartridge 10 is newly set in the carriage 15, a not-shown label is taken off the ink cartridge 10. Then the flexible film 43 is pulled out along with the label, so the ink chamber 32 is connected to the absorbent chamber 34. Also the seals 46 and 47 are partly peeled off, to expose the air introduction holes 44 and 45 partly. Thereafter, upon the cartridge changing button 24 being operated, the carriage 15 moves to the changing position. Then, the printer lid 17 of the printer 11 is opened to replace the used ink cartridge 10 with new one. As the new ink cartridge 10 is set in the carriage 15, the sealing member 41 is broken, so the ink 31 is supplied through the ink spout 40 to the recording head 53. Thereafter, the printer lid 17 is closed.

In a given time after the printer lid 17 is closed, the carriage 15 is moved to the standby position. Then, the fuel spout 48 of the ink cartridge 10 is connected to the connector 54, and the on-off valve 50 opens in cooperation with it, feeding the liquid fuel 35 from the fuel chamber 36 to the fuel tank 56.

When the carriage 15 begins to move responsive to a print command, the fuel spout 48 is disconnected from the connector 54, and the on-off valve 50 is closed in cooperation with it. So the fuel supply from the fuel chamber 36 is interrupted while the carriage 15 is moving. Thus, the liquid fuel 35 is fed from the fuel chamber 36 to the fuel tank 56 when the carriage 15 reaches the standby position and, thereafter, the liquid fuel 35 is supplied from the fuel tank 56.

Alternatively, it is possible to provide the carriage 15 with the connector 54 for the fuel spout 48, and connect the connector 54 to the fuel tank 56 through an elastic pipe or tube. The elastic pipe or tube changes its length following to the movement of the carriage 15, so that the liquid fuel 35 may be fed from the fuel chamber 36 to the fuel tank 56 even while the carriage 15 is moving.

The used ink cartridge 10 is collected in a factory for the sake of reuse or recycle. In the factory, the recovered cartridge case 30 is disassembled to replace the sponge 33 with new one. Then, the cartridge case 30 is reassembled, and refilled with the ink 31 and the liquid fuel 35, to produce a reused or recycled ink cartridge 10.

As well known in the art, the printer 11 radiates heat during the printing, that is, while the recording head is being driven. Particularly, ink ejection energy generating elements of the recording head generate heat energy while they are operating, and rise the temperature inside the printer 11. If the temperature of the ink 31 changes, its properties will change. According to the present invention, however, since the fuel chamber 36 containing the liquid fuel 35 is provided around the ink chamber 32, the heat transmitted from the printer 11 to the ink cartridge 10 is blocked by the liquid fuel 35 from the ink 31. So the ink 31 in the ink chamber 32 is kept in a constant temperature range, keeping its properties unchanged for a long time.

Note that the fuel chamber 36 may not always be located above and on one side of the ink chamber 32, but may be located below and on one side of the ink chamber 32, or below, above and on one side of the ink chamber 32. Preferably, the fuel chamber 36 is located on the outer side of the ink chamber 32, to isolate the ink chamber 32 from heat transmitted from outside the ink cartridge 10.

Figure 5:
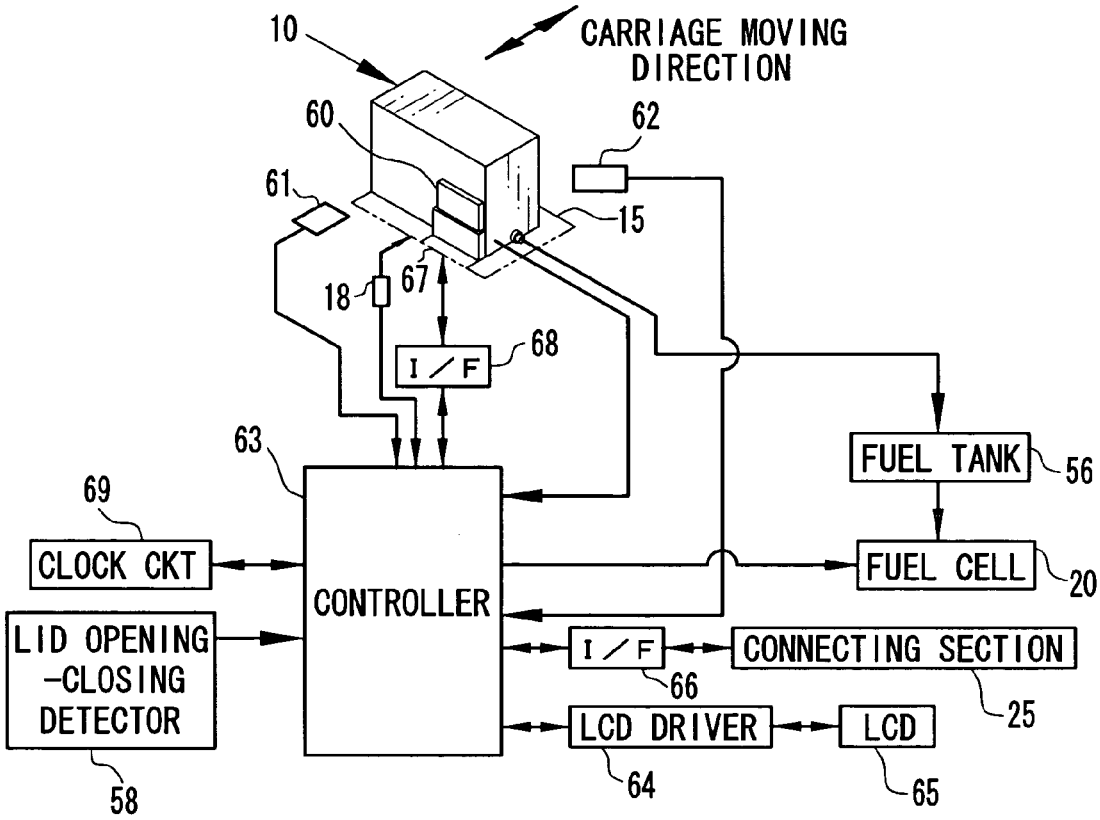
FIG. 5 is a block diagram illustrating a circuitry of the ink jet printer.

The ink cartridge 10 is provided with a memory card 60, as shown in FIG. 5. The memory card 60 is removably attached to the ink cartridge 10, and stores identification data of the ink cartridge 10, and data on the ink and the liquid fuel, e.g. data on their residual amounts or data indicating that the ink or the liquid fuel is used up, and data on the date and time of detection of these data, and cartridge changing data indicating the date of changing the ink cartridge 10. The memory card 60 is removed from the cartridge casing 30 in the recycling factory, to read the stored data from the memory card 60 and utilize them for collecting data as to how long the ink cartridge 10 has been used, and how much liquid fuel 35 remains in the ink cartridge 10 when the ink chamber 32 get empty.

A residual ink detector (first residual amount detector) 61 and a residual fuel detector (second residual amount detector) 62 are mounted to the carriage 15. The residual ink detector 61 and the residual fuel detector 62 are respectively constituted of a number of reflective photo sensors arranged on top of another, wherein each of the reflective photo sensors consists of a light emitter and a light receiver. Based on the signal levels from the photo sensors, a controller 63 measures the levels of the residual ink and the residual fuel, for example, in four grades: high, middle, low and empty.

Since the cartridge case 30 is at least partly transparent, the photo sensors can detect the residual ink and fuel through the cartridge case 30. Instead of the photo sensors, it is possible to use a device that enters the ink chamber 32 and the fuel chamber 36 to measure electric resistances of the ink and the liquid fuel, and derive the residual amounts from the measured electric resistances. Alternatively, it is possible to count the number of dots printed by the recording head, and estimate the residual amounts based on the count.

The controller 63 controls the overall operation of respective parts of the printer 11, and is provided with a residual amount data pickup device, a deciding device, a comparing device, a notifying device, a memory access device and other minor devices. The residual amount data pickup device picks up data on the residual amounts of the ink 31 and the liquid fuel 35 from the residual ink detector 61 and the residual fuel detector 62. The residual amount data pickup device picks up the residual amount data at regular intervals after the power switch 23 is turned on and while the carriage 15 is in the standby position, and also each time the cartridge changing button 24 is operated. The memory access device includes a writing device for writing the data on the ink 31 and the fuel 35 in the memory card 60 in association with the residual amount data picked up through the residual amount data pickup device, and a reading device for reading the data out of the memory card 60.

The deciding device decides whether to change the ink cartridge 10 or not, based on the residual amount data obtained from the residual ink detector 61. When the deciding device decides that the ink cartridge 10 should be changed, the notifying device sends out a notification signal to an LCD driver 64 to drive an LCD 65 to display a need to change the ink cartridge 10. The notifying device may also send the notification signal through an interface (I/F) 66 and the connecting section 25 to an external apparatus like a personal computer.

The ink cartridge 10 has an electric connector 67 at its external position, that is connected to the controller 63 through an interface 68 provided on the carriage 15. So the memory access device of the controller 63 reads or writes the data on the ink and the liquid fuel out of or into the memory card 60 via the connector 67 and the interface 68.

The deciding device compares the residual amount data read out from the memory card 60 with the residual amount data presently picked up from the residual ink detector 61 and the residual fuel detector 62, to check if the residual amount of the ink 31 or the liquid fuel 35 in the ink cartridge 10 is more than that indicated by the data read out from the memory card 60. If the present residual amount of the ink 31 or the liquid fuel 35 is more than before, i.e., more than the residual amount read out from the memory card 60, the notifying device generates a notification signal. Responding to this notification signal, the controller 63 outputs a signal to the LCD driver 64 to display such a notification or warning on the LCD 65 that the ink cartridge 10 is not new or the ink cartridge 10 is a recycled one. The controller 63 may also output the notification signal to an external apparatus like a personal computer through the interface 66 and the connecting section 25.

The time to change the ink cartridge 10 may be decided based on the residual amount data from the residual fuel detector 62 as well as those from the residual ink detector 61. In that case, the time to change the ink cartridge 10 is determined by checking the residual amount of the ink 31 first. Thereafter when it is judged that the ink cartridge 10 is not to be changed in view of the ink 31, the residual amount of the liquid fuel 35 is checked to decide as to whether the ink cartridge 10 is to be changed or not. If the residual fuel is less than a threshold, it is judged that the ink cartridge 10 should be changed, and the notification signal is generated, even while the residual amount of the ink 31 is more than a threshold. It is possible to check the residual amount of the liquid fuel 35 first, and then check the residual amount of the ink 31. That is, the need to change the ink cartridge 10 may be notified as soon as it is determined based on the residual amount data of the ink 31 or the ink chamber 32 from the residual ink detector 61 or the residual fuel detector 62. The printer 11 is further provided with a lid opening-closing detector 58 for detecting that the printer lid 17 is opened and closed.

As described above, the data on the ink and the liquid fuel include data on their residual amounts or data indicating that the ink or the liquid fuel is used up, and data on the date and time of detection of these data. The printer 11 has a clock circuit 69 that counts clock pulses to output clock data representative of date and time. The controller 63 reads the clock data and stores them in association with the detected residual amounts on the memory card 60. Thereafter, the controller 63 gets in a standby state, waiting for a print command.

It is possible to provide the printer 11 with a device for detecting a residual amount of the liquid fuel 35 in the fuel tank 56, and provide an on-off valve in the pipe 55, so that the controller 63 controls the on-off valve to open or close automatically based on the residual amount data obtained from the device for detecting a residual amount of the liquid fuel 35 in the fuel tank 56. According to this embodiment, the on-off valve is opened to supply the liquid fuel 35 from the fuel chamber 36 to the fuel tank 56 when the fuel tank 56 is about to run out of the liquid fuel 35, and then the on-off valve is closed when the fuel tank 56 is filled with the liquid fuel 35.

So the fuel tank 56 is kept safely without being supplied with too much fuel. In that case, it is preferable to estimate the supplied amount of the liquid fuel 35 based on the time from opening to closing the on-off valve, and record it on the memory card 60.

Figure 6:
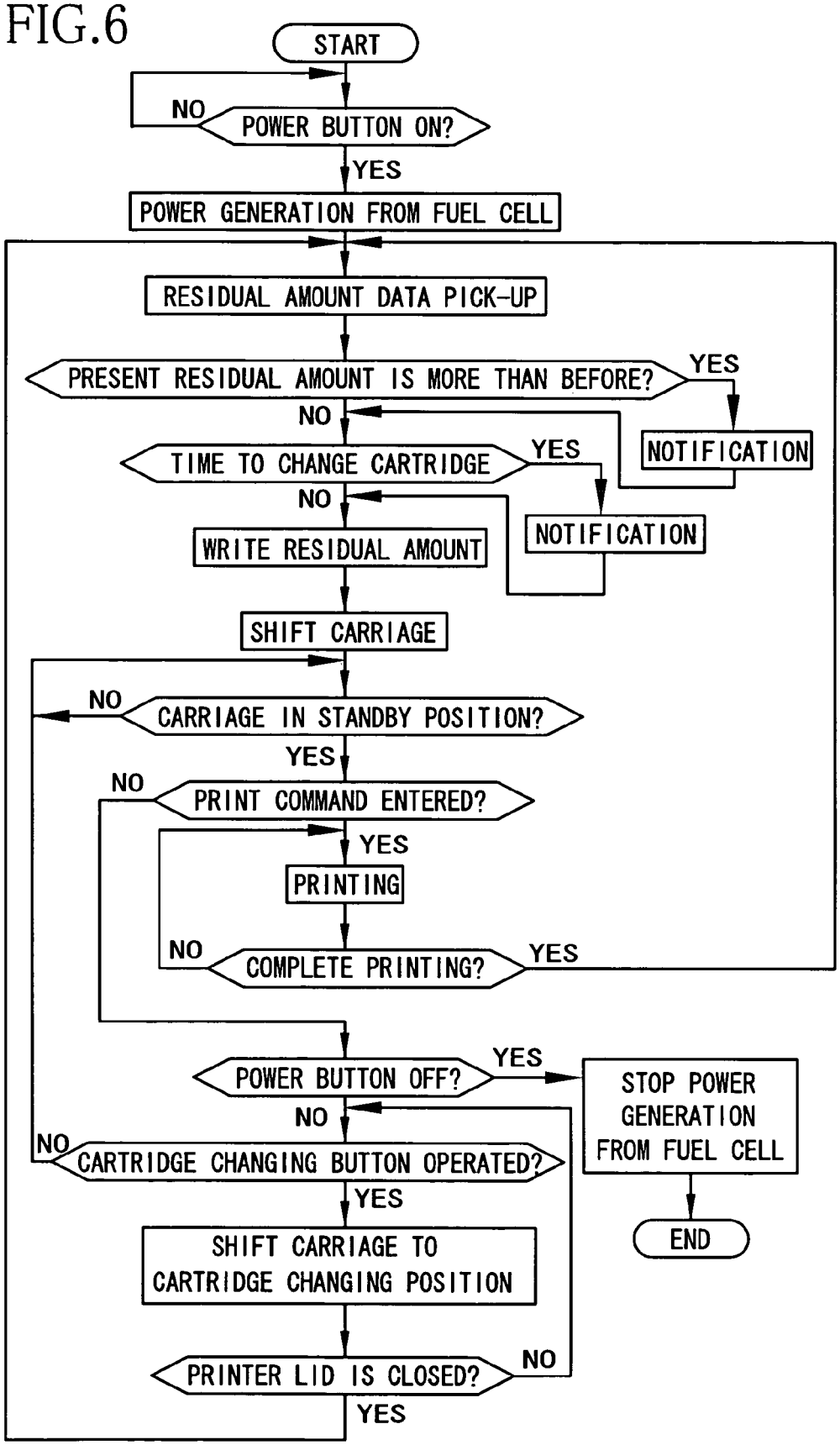
FIG. 6 is a flow chart illustrating a sequence of operation of the ink jet printer.

Now the overall operation of the printer 11 will be described with reference to FIG. 6.

Upon the power switch 23 being turned on, the fuel cell 20 starts generating power to supply the printer 11. Then, the controller 63 checks if the carriage 15 is in the standby position. If not, the carriage shifting mechanism 18 is driven to set the carriage 15 to the standby position. Thereafter, the residual amount data are picked up through the residual ink detector 61 and 62.

The controller 63 compares the residual amount data presently picked up through the residual ink detector 61 and the residual fuel detector 62 with the preceding residual amount data written in the memory card 60. If the present residual amount of the ink 31 or the liquid fuel 35 is more than that measured before, the printer 11 gives the warning that the ink cartridge 10 is not new or is a recycled one. Thereafter, the controller 63 decides based on the residual amount of the ink 31 whether to change the ink cartridge 10 or not. If it is the time to change the ink cartridge 10, the controller 63 notifies of it. Then the data on the ink 31 and the liquid fuel 35 at the time of detecting the residual amounts are written in the memory card 60.

In addition to the time when the power switch 23 is turned on, the data are written in the memory card 60 at regular intervals while the carriage 15 is in the standby position, as well as after the cartridge changing button 24 is operated. When the cartridge changing button 24 is operated, the carriage 15 is shifted to the cartridge changing position. Then the printer lid 17 is opened, and the ink cartridge 10 is changed with another. Thereafter when the printer lid 17 is closed, the lid opening-closing detector 58 detects it, so the controller 63 picks up data on the ink 31 and the liquid fuel 35 again to write them in the memory card 60. The residual amount data are written time-sequentially in the memory card 60. But it is possible to revise the data such that the memory card 60 stores merely present and preceding residual amount data.

The ink cartridge 10 taken out from the printer 11 is collected with the memory card 60 into the recycling factory. In the factory, the memory card 60 is removed to read out and store them with those read out from other memory cards 60 as attached to other ink cartridges 10. Thereafter, all the data are erased from the memory card 60, and a new ID number is written in the memory card 60 to reuse it. On the other hand, the used ink cartridge 10 is refilled with the ink 31 and the liquid fuel 35, to reuse the cartridge case 30.

In place of the memory card 60, the residual amount data may be written on another storage medium, e.g. a radio IC chip like an RFID tag, insofar as it is removably attachable to the cartridge case 30. In a case where the RFID tag is used as the memory, a radio communication device is used as the memory access device that read and write the RFID tag by way of electric waves or electromagnetic waves. It is also possible to integrate the memory card 60 or another storage medium in the printer 11, instead of attaching it to the ink cartridge 10. The storage medium may be a flexible disc or CD-ROM.

Figure 7:
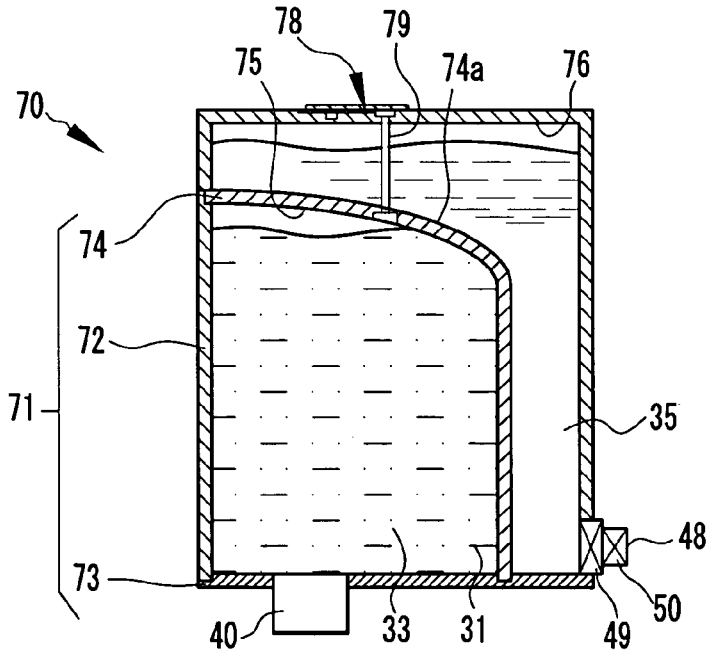
FIG. 7 is a sectional view of another ink cartridge, wherein an ink chamber and an absorbent chamber are formed as an integral ink storage chamber.

FIG. 7 shows an embodiment of an ink cartridge 70 that has a single ink storage chamber 75, instead of the ink chamber 32 and the absorbent chamber 34 of the ink cartridge 10. The ink storage chamber 75 contains a sponge 33 compressed and soaked with the ink 31. In the present embodiment, the ink storage chamber 75 constitutes the first consumable product storage chamber. The ink cartridge 70 has a cartridge case 71 that consists of a main body 72, a lid 73 and a partitioning wall 74. By setting the partitioning wall 74 in the main body 72, the casing is partitioned into the ink storage chamber 75 and a fuel chamber 76. The fuel chamber 76 is located in adjacent to the ink storage chamber 75 to surround the right, left and top side of the ink storage chamber 75. A roof portion 74*a* of the partitioning wall 74 curves gently downward so that the liquid fuel 35 flows smoothly down into a fuel spout 48. The fuel spout 48 is formed at a lower position of a side wall of the casing 71. Designated by 78 is an air introduction hole. The air introduction hole 78 introduces the air not only from outside into the fuel chamber 76, but also into the ink storage chamber 75 through a pipe 79 that connects the air introduction hole 78 to a hole formed in the roof portion 74*a* of the partitioning wall 74.

Figure 8:
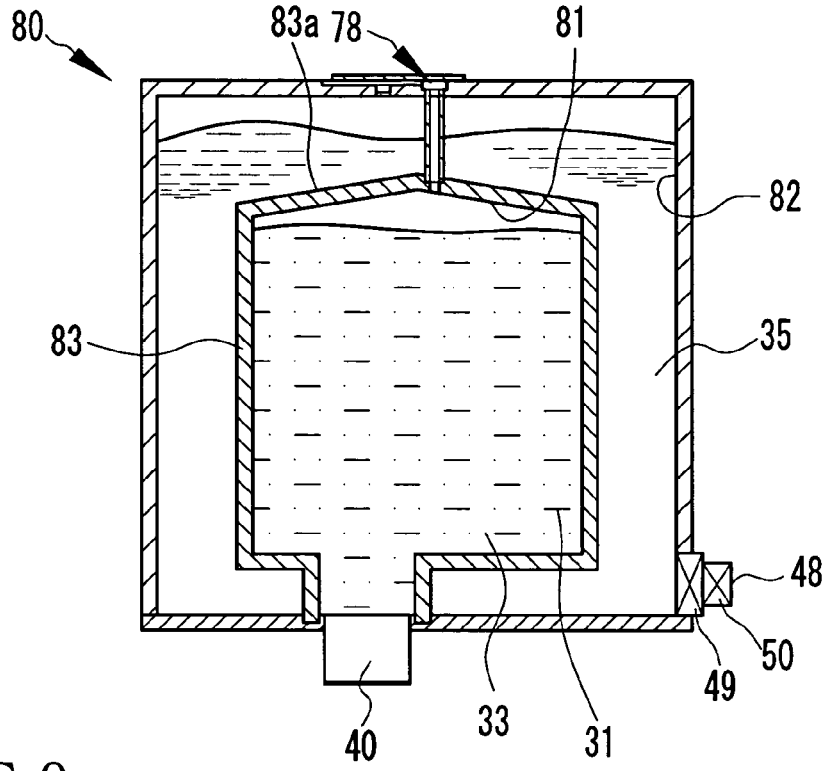
FIG. 8 is a sectional view of still another ink cartridge, wherein a fuel chamber surrounds an ink chamber.
Figure 9:
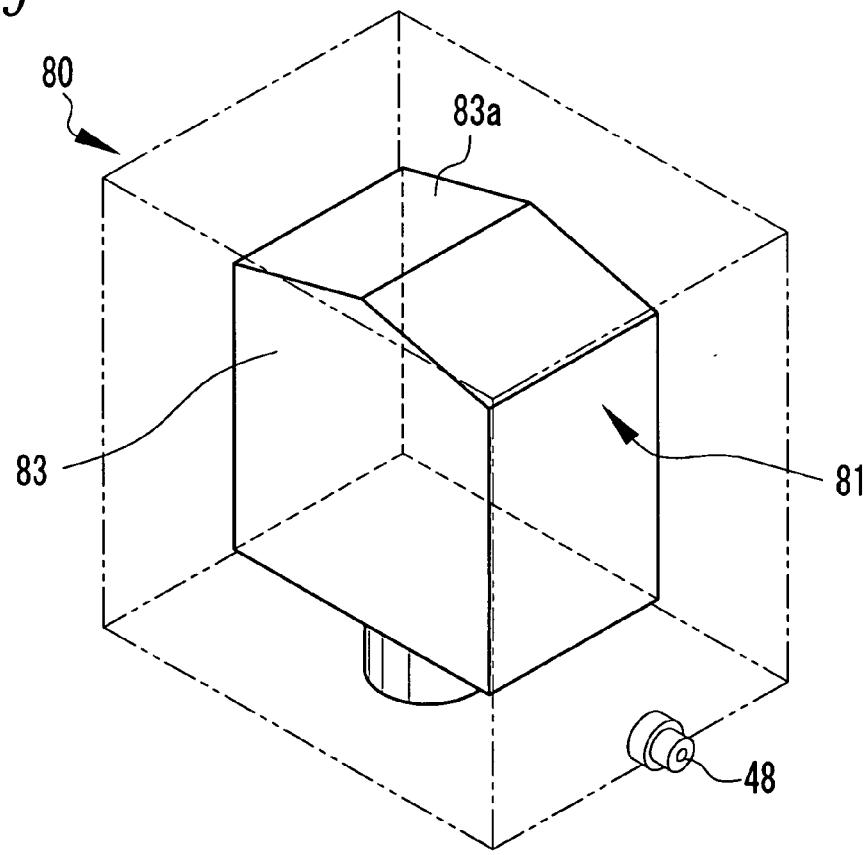
FIG. 9 is a perspective view of the ink cartridge of FIG. 8, illustrating its exterior transparently to show its interior.

FIGS. 8 and 9 shows another embodiment of an ink cartridge 80 wherein a fuel chamber 82 surrounds all sides of an ink storage chamber 81 except an area including an ink spout 40. In other words, the fuel chamber 82 is formed in the center of the ink storage chamber 81, and is mostly set away from a bottom wall of the ink storage chamber 81. A roof portion 83*a* of a partitioning wall 83 between the ink storage chamber 81 and the fuel chamber 82 inclines downward from the center to the opposite sides, so that the liquid fuel 35 flows down smoothly.

Although the present embodiments have been described with respect to the printer 11 using the black ink cartridge 10 alone, the present invention is not to be limited to the printer 11, but may be applied to a full-color printer using a number of ink cartridges containing different colors. In that case, the printer should have the same number of connectors as the requisite number of ink cartridges. Each of the ink cartridges may be provided with a fuel chamber containing the liquid fuel. Alternatively, as the mounting positions of the different color ink cartridges to the carriage are designated in the full-color printer, it is possible to provide the fuel chamber only in an ink cartridge of a designated color.

There is an ink cartridge that has a plurality of ink storage chambers storing different colors from each other, so that the inks of different colors may be changed at once. In such an ink cartridge, the ink storage chambers of different colors are arranged side by side, and are integrated into one body. In such an ink cartridge, it is preferable to form a fuel chamber to have an inverted U-shape, to extend from the outer side of a terminal one of the ink storage chambers over the respective ink storage chambers to the outer side of the other terminal ink storage chamber. According to this configuration, the fuel chamber has a large volume. It is also preferable to form the fuel chamber so as to extend between the ink storage chambers.

In the above-described embodiment, the recording head including the ejection energy generating elements is mounted to the carriage 15 of the ink jet printer 11. But the present invention is applicable to an ink cartridge having a recording head integrated therewith.

Although the above-described embodiments relate to those consumable product containers which contain at least ink as the first consumable product and is provided with a fuel chamber containing a liquid fuel as the second consumable product, it is possible to provide an air chamber instead of the fuel chamber. Like the fuel chamber, the air chamber provides the same effect of isolating the ink storage chamber from heat. In that case, the water sub-produced from the fuel cell may be fed to the air chamber through a pump or the like, so that the water can be recovered together with the consumable product container.

Furthermore, the consumable product container of the present invention is not limited to an ink cartridge that contains ink as the consumable product, but also embodied as a cartridge that contains toner as the consumable product, and is used in an electrostatic copier that is powered by a fuel cell. In that case, the electrostatic copier constitutes an image forming apparatus of the invention.

There are two types of cartridges for use in the electrostatic copiers. One is a toner cartridge that merely supplies toner. The other is a process cartridge that not only contains toner but is also provided with processing components. Since both types have a toner storage chamber as the consumable product storage chamber, a fuel chamber may be formed around the toner storage chamber.

Figure 10:
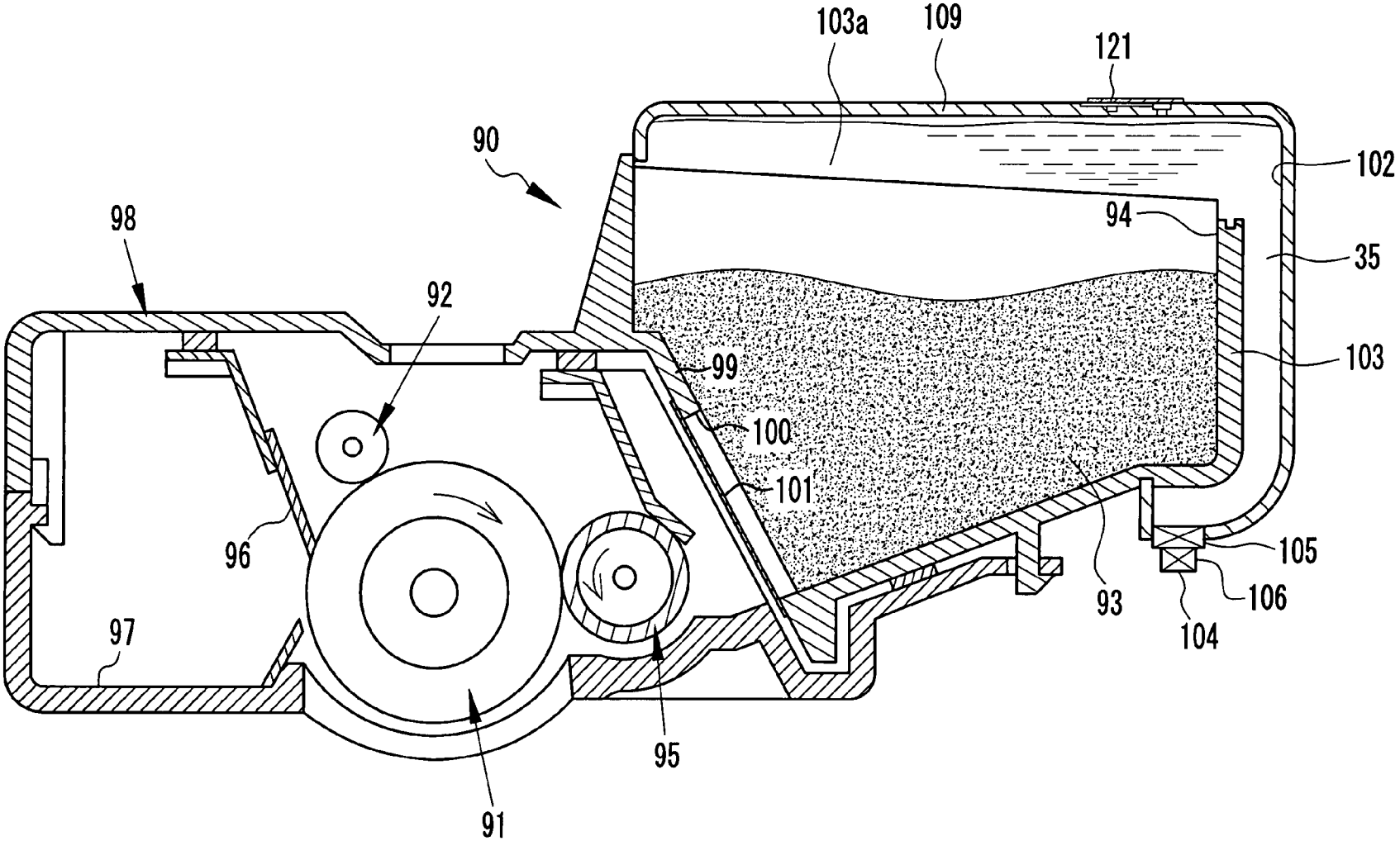
FIG. 10 is a sectional view of a process cartridge having a fuel chamber integrated therein.

FIG. 10 shows a process cartridge 90 according to an embodiment of the present invention. The process cartridge 90 not only contains the toner 93 in a toner storage chamber 94, but also has processing components, including a photoconductive drum 91, an electrifying device 92, a developing roller 95 and a cleaning blade 96, in its cartridge case 98. The electrifying device 92 is driven by an electrification circuit, to electrify the photoconductive drum 91, so as to form an electrostatic latent image on the photoconductive drum 91. The developing roller 95 develops the electrostatic latent image into a toner image by use of the toner 93 supplied from the toner storage chamber 94. The cleaning blade 96 withdraws the toner from the photoconductive drum 91, and collects the toner in a toner recovery chamber 97 that is also formed in the process cartridge 90. The cartridge case 98 is constituted of a number of covers made of a light-tight resin material, and is sectioned into the toner storage chamber 94, the toner recovery chamber 97 and a section mounting the processing components. The process cartridge 90 is expected to be recycled.

The toner storage chamber 94 is isolated by a wall 99. The wall 99 has a cutout 100, and a flexible film 101 is attached to cover the cutout 101, to isolate the toner storage chamber 100. The flexible film 101 is pulled out from the cartridge case 98 immediately before the process cartridge 90 is set in an electrostatic copier. Thereby, the toner 93 is fed from the toner storage chamber 94 to the developing roller 95. Then, the toner 93 is transferred as an image onto recording paper as being conveyed through the copier.

A fuel chamber 102 is formed adjacently to the toner storage chamber 94, by mounting a cover 109 around the toner storage chamber 94. In this embodiment, the cover 109 is made of a transparent resin material, so that the liquid fuel 35 remaining in the fuel chamber 102 is visible from outside. Designated by 103 is a partitioning wall between the toner storage chamber 94 and the fuel chamber 102. The fuel chamber 102 has a fuel spout 104 at a lower position, so as to be exposed to outside. In the fuel spout 104, there are a check valve 105 and an on-off valve 106. The check valve 105 prevents reverse flow of the liquid fuel 35. The on-off valve 106 closes the fuel spout 104 until the process cartridge 90 is set in the copier, and automatically opens when the fuel spout 104 is connected to a connector of the copier. A roof portion 103*a* of the wall 103 inclines downward so that the liquid fuel 35 flows smoothly down into the fuel spout 104. The liquid fuel 35 is supplied through the fuel spout 104 to a fuel cell of the copier. Designated by 121 is an air introduction hole for the fuel chamber 102.

As well known in the art, the copier has a fixing section for fixing the toner 93 on the recording paper by heating and pressuring the toner 93 on the recording paper. Because of the heat energy radiated from the fixing section, the internal temperature of the copier increases while the copier is operating. If the toner 93 is heated too much, its properties will change. In the present embodiment, however, the toner storage chamber 94 is surrounded by the fuel chamber 102 containing the liquid fuel 35, so the heat transmitted from the copier to the process cartridge 90 is blocked by the liquid fuel 35 from the toner 93. So the toner 93 in the toner storage chamber 94 is kept in a constant temperature range, so the toner 93 is prevented from deterioration. Note that it is possible to provide the process cartridge 90 with such a memory card as described with reference to FIG. 5, to record data on the toner 93 and the liquid fuel 35 in the memory card.

The consumable product is not limited to the ink or the toner, but may be recording paper. In that case, the recording paper as a consumable product is contained in a cassette in the form of a roll of elongated paper web or a pile of paper sheets. The cassette may be of a type capable of reloading the recording paper, or of a single-use type wherein the recording paper is sealed up, so the cassette should be changed as the whole with a new one. In either type, the cassette may be sectioned into a paper storage chamber for containing the recording paper and a fuel chamber for containing the liquid fuel. In that case, the paper storage chamber constitutes the consumable product storage chamber of the present invention.

Because the re-loadable cassette is used almost forever, the fuel chamber is preferably configured such that a fuel cartridge containing the liquid fuel is removably loaded in the fuel chamber, so that the liquid fuel can be replenished at the same time when the recording paper is loaded in the paper storage chamber. On the other hand, the single-use cassette may have the fuel chamber formed around the paper storage chamber. The single-use cassette is preferably recovered for recycling or reuse.

The recording paper may be plain paper, heat sensitive paper or photosensitive paper. The recording paper can deteriorate when heated too much or for a long time. However, because the fuel chamber containing the liquid fuel is provided around the paper storage chamber, the recording paper is kept in a constant temperature range, so the deterioration of the recording paper is prevented.

Although the fuel chamber contains the liquid fuel, such as methanol or liquid hydrogen, in the above-described embodiments, the fuel chamber may contain a gas fuel, such as hydrogen, natural gas or DME. In that case, the fuel chamber is made gas-tight without any air introduction hole.

In the above-described embodiment, the image forming apparatus is supplied directed from the fuel cell. It is possible to provide the image forming apparatus with a secondary cell or rechargeable battery, so that the power generated from the fuel cell may be accumulated in the secondary cell. Then, the image forming apparatus is driven by the power supplied from the secondary cell.

Thus the present invention is not to be limited to the above-described embodiments, but various modifications will be possible without departing from the scope of claims as appended hereto.

What is claimed is:

1. A consumable product container removably set in an image forming apparatus that operates using electric power supplied from a fuel cell, said consumable product container containing a consumable product that said image forming apparatus uses to form an image, comprising:

a consumable product storage chamber for storing said consumable product; and a fuel chamber for storing fuel to be supplied to said fuel cell, said fuel chamber being located around said consumable product storage chamber and adjacent to at least two surfaces of said consumable product storage chamber.

2. A consumable product container as claimed in claim 1, wherein said consumable product is ink or toner.

3. A consumable product container as claimed in claim 2, wherein said fuel is a liquid fuel, and in a posture as said consumable product container is mounted in said image forming apparatus, said fuel chamber is located at least on a top of said consumable product chamber, and a fuel spout for feeding out said fuel to said image forming apparatus is provided at a lower part of said fuel chamber, and wherein a top wall portion of a partitioning wall between said consumable product storage chamber and said fuel chamber is inclined such that said liquid fuel flows down to said fuel spout.

4. A consumable product container as claimed in claim 1, wherein said consumable product is ink, and said consumable product storage chamber is parted into an ink chamber storing said ink and an absorbent chamber containing an absorbent that absorbs said ink from said ink chamber and holds said ink, and wherein said fuel chamber is located around said ink chamber.

5. A consumable product container as claimed in claim 1, wherein said consumable product is toner, and said consumable product container is a program cartridge, into which a toner storage chamber, a photoconductive drum for forming an electrostatic latent image thereon, an electrifying device for electrifying said photoconductive drum, a developing roller for developing the electrostatic latent image into a toner image by use of the toner supplied from said toner storage chamber, a cleaning blade for recovering the toner from said photoconductive drum, and a toner recovery chamber for collecting the recovered toner are integrated.

6. A consumable product container as claimed in claim 1, further comprising a memory for storing data on said consumable product and said fuel.

7. A consumable product container as claimed in claim 6, wherein said memory is removably attached to said consumable product container.

* * * * *